US008020241B1

(12) United States Patent
Farmer et al.

(10) Patent No.: US 8,020,241 B1
(45) Date of Patent: Sep. 20, 2011

(54) SQUEEGEE WITH AN INTEGRATED TRACK SYSTEM

(76) Inventors: David Farmer, Belleview, FL (US); Lynda Farmer, Belleview, FL (US)

( * ) Notice: Subject to any disclaimer, the term of this patent is extended or adjusted under 35 U.S.C. 154(b) by 1005 days.

(21) Appl. No.: 11/874,654

(22) Filed: Oct. 18, 2007

(51) Int. Cl.
*A47L 1/00* (2006.01)

(52) U.S. Cl. ..... 15/103; 15/250.001; 15/250.11; 15/245

(58) Field of Classification Search ..... 15/250.001, 15/250.11, 250.29, 245, 103, 220.1
See application file for complete search history.

(56) References Cited

U.S. PATENT DOCUMENTS 820,688 A * 5/1906 Williams ..... 15/250.29
4,075,730 A 2/1978 Siemund
4,208,755 A 6/1980 Shepherd
D280,247 S 8/1985 Jones
4,916,764 A 4/1990 Meaden et al.
5,101,530 A 4/1992 Hansen et al.
6,546,590 B2 * 4/2003 Waters ..... 15/250.003
6,834,411 B2 12/2004 Kaminstein et al.

* cited by examiner

*Primary Examiner* — Shay L Karls

(57) ABSTRACT

The invention is a squeegee, consisting of a handle and blade assembly that is mounted on a set of tracks. The blade assembly has a left and a right side mounted roller which are designed to operate inside of each track. The side mounted rollers will allow the blade to move upwards and downwards on the tracks. Once installed, the track system ensures that the squeegee maintains constant pressure against the planar surface. In the preferred embodiment, the top of the tracks will feature a hook type design for the use of attaching the invention to the top of a planar surface. An alternative embodiment has the track mounted to the frame of the door or window. A third embodiment integrates a motorized squeegee that has the track mounted to the shower door or window.

3 Claims, 6 Drawing Sheets

SQUEEGEE WITH AN INTEGRATED TRACK SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates generally to the field of cleaning implements, and more specifically, to an improved squeegee system for cleaning generally planar surfaces such as glass, plastic panels and enclosures, tiles, and window panes.

B. Discussion of the Prior Art

The Hanson at al. Patent (U.S. Pat. No. 5,101,530) discloses an improved light-weight squeegee suitable for use in and around the home for cleaning and drying planar surfaces. The Hanson Patent uses S-shaped blades that are co-extruded from thermoplastics, each having a different hardness. However, the squeegee disclosed in the Hanson Patent does not include any type of track system to guide the squeegee along the planar surface to be cleaned.

The Kaminstein et al. Patent (U.S. Pat. No. 6,834,411) discloses a squeegee assembly that includes a handle connected to the blade. The handle assembly has a hole which allows for convenient storage of the squeegee. The Kaminstein Patent is similar to the present invention as both have a handle type assembly connected to the squeegee blade, however, the Kaminstein Patent differs from the present invention because it fails to provide any type of track to guide the squeegee along the planar surface.

The Shepherd Patent (U.S. Pat. No. 4,208,755) discloses a wiper for attachment to the bottom edge of a window, or a shower door, so that when the shower door or window is opened or closed the track along which it runs is wiped clear. While the Shepard Patent does employ a squeegee type device to clear standing fluid and this device is mounted to a track, the present invention uses a track type system that is not dependent on the movement of a planar surface to achieve cleaning and drying of a planar surface. Furthermore, the present invention can be moved to different planar surfaces, while the Shepard Patent is more permanently suited to a relatively small track.

The Meaden et al. Patent (U.S. Pat. No. 4,916,764) discloses a bathtub retractable shower curtain assembly that has a set of wipers which clean the shower curtain during its extension and retraction. The Meaden Patent use a track type system that is dependent on the movement of a planar surface to achieve cleaning and drying of a planar surface; whereas, the present invention does not require the movement of planar surfaces and it can be moved to different planar surfaces. Furthermore, the bathtub retractable shower curtain assembly is limited to the shower curtain and not any other planar surface requiring a squeegee.

The Siemund Patent (U.S. Pat. No. 4,075,730) discloses a squeegee construction for shower and bath surfaces. The Siemund Patent differs, however, because its utility does not provide any type of track to guide the squeegee along the planar surface.

The Jones Patent (U.S. Pat. No. Des. 280,247) illustrates a design for a squeegee, which lacks any illustration of a corresponding track system.

BRIEF SUMMARY OF THE INVENTION

The invention is a squeegee, consisting of a handle and blade assembly that is mounted on a set of tracks. The blade assembly has a left and a right side mounted roller which are designed to operate inside of each track. The side mounted rollers will allow the blade to move upwards and downwards on the tracks. Once installed, the track system ensures that the squeegee maintains constant pressure against the planar surface. In the preferred embodiment, the top of the tracks will feature a hook type design for the use of attaching the invention to the top of a planar surface. An alternative embodiment has the track mounted to the frame of the door or window. A third embodiment integrates a motorized squeegee that has the track mounted to the shower door or window.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
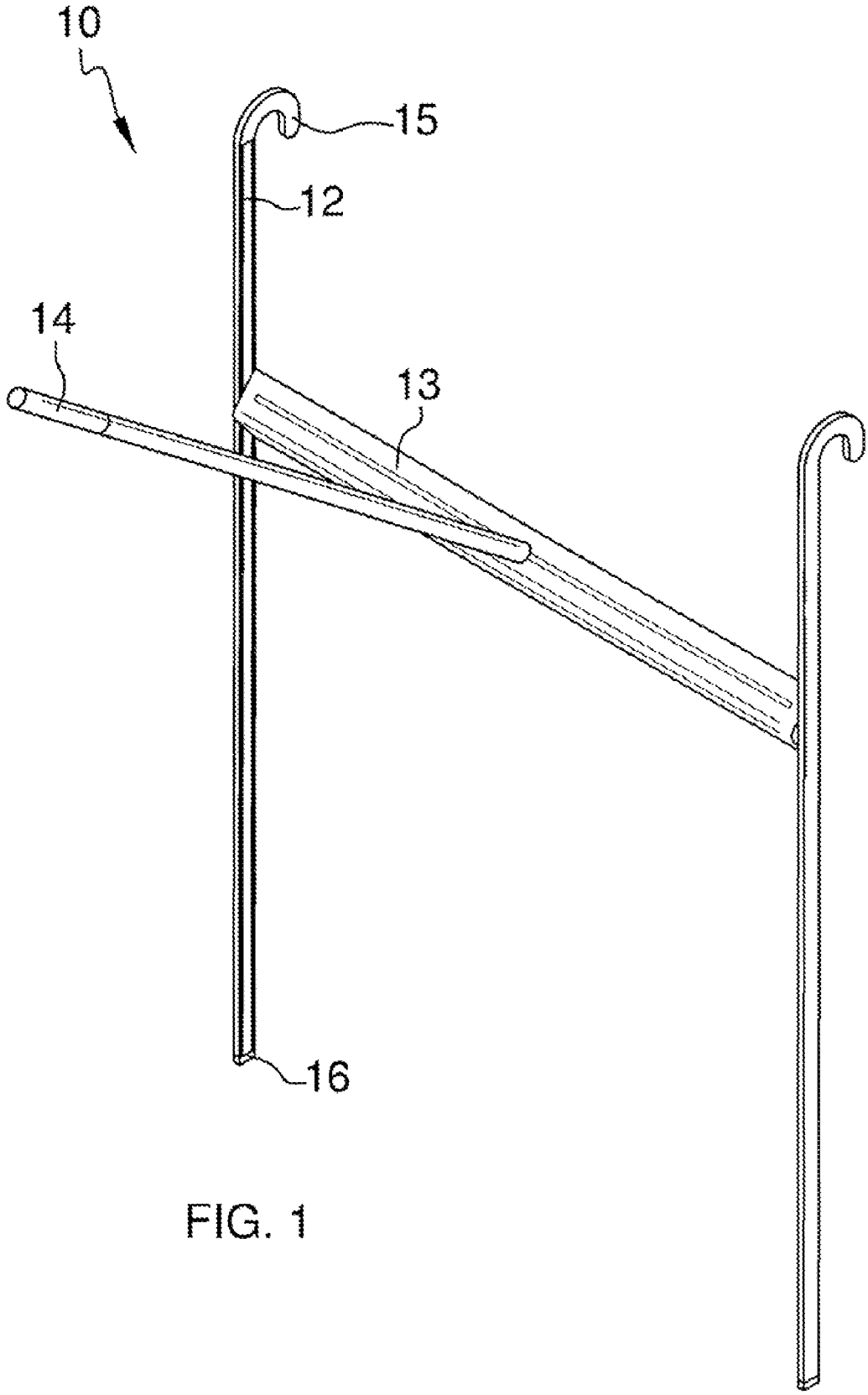
FIG. 1 illustrates an isometric view of the invention by itself.

Detailed reference will now be made to the preferred embodiment of the present invention, examples of which are illustrated in FIGS. 1-5. The invention 10 includes a pair of tracks 12, a squeegee 13, and a squeegee handle 14. Each track 12 will have rubber pad 16 on the bottom of each track 12.

In the preferred embodiment of the present invention, each track 12 will have a hook shaped end 15 on the upper end of the track 12 that will allow the invention 10 to be mounted the top of a shower door 22. In the alternative embodiment of the present invention 10, each track 12 will have a suction cup apparatus (not shown) on the top and bottom of each track 12.

Figure 2:
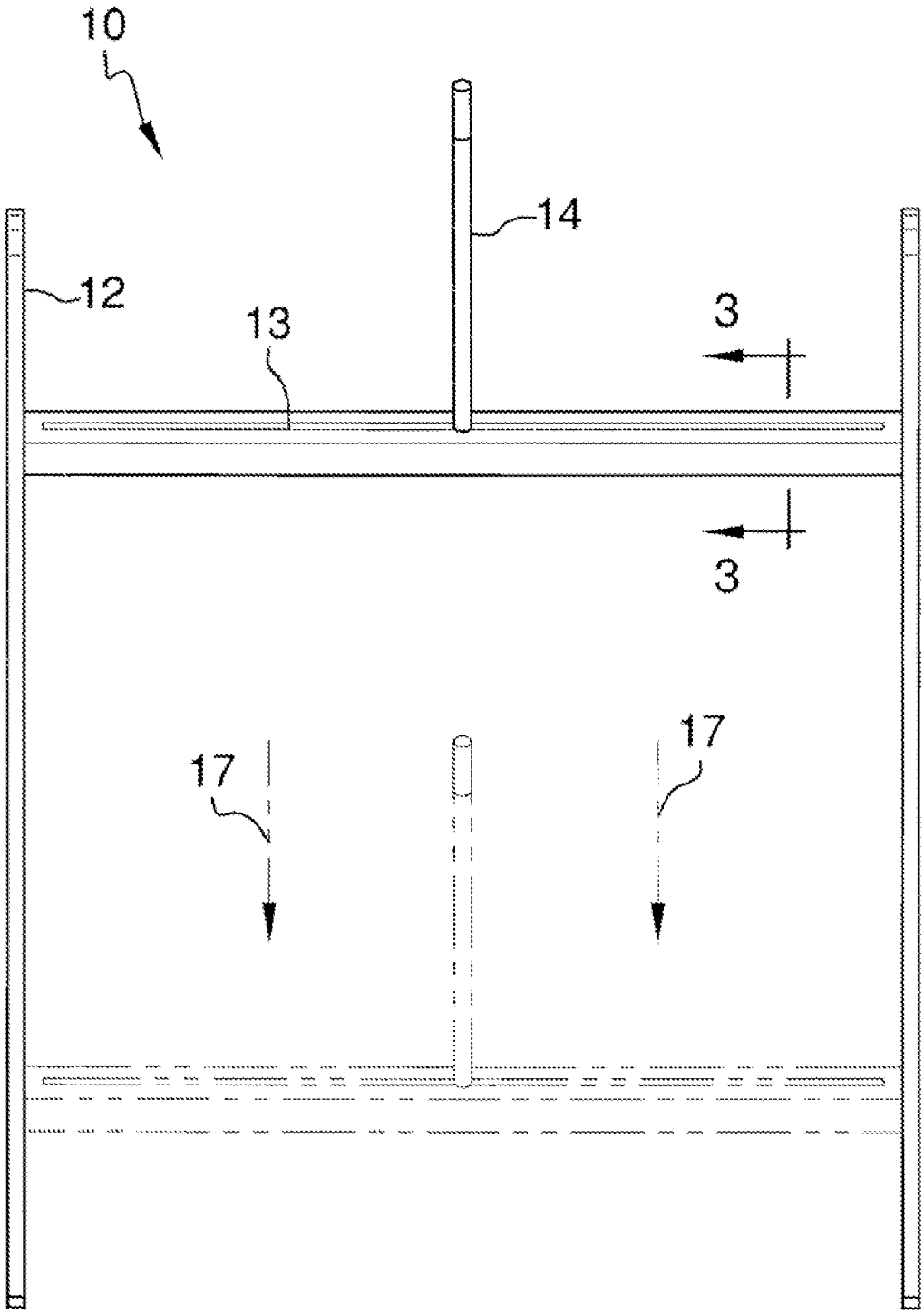
FIG. 2 illustrates a front view of the invention illustrating a downward movement of the squeegee.
Figure 3:
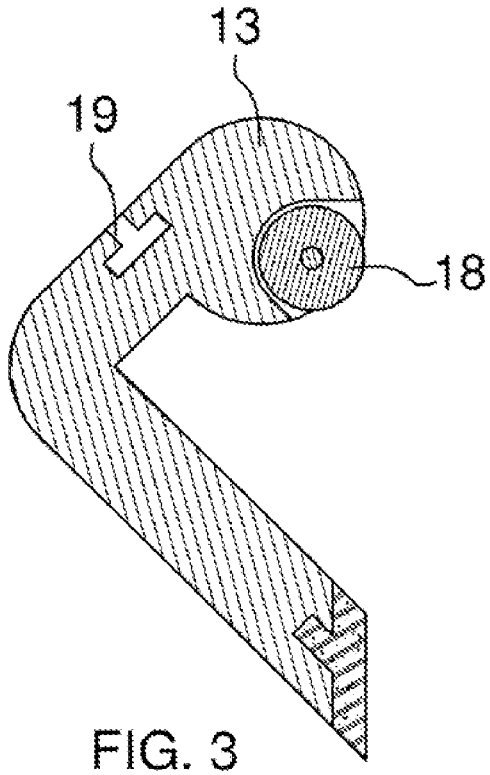
FIG. 3 illustrates a cross-sectional view of the squeegee along line 3-3 in FIG. 2.

Referring to FIG. 2, the squeegee 13, in its upward position will move downward 17 along both tracks 12. During the downward movement, the handle 14 will provide leverage that is applied in forcing the squeegee against the planar surface. The inclusion of the tracks 12 and roller assemblies 18 insure a horizontal movement of the squeegee while in use.

The addition of the rubber pads 16 at each end of the track 12 insure that once the squeegee is lowered to the bottom of the track 12, the roller assembly 18 will not simply roll out of the end of the track 12. The rubber pads 16 shall be made of a durable rubber and be designed to securely fasten itself to the end of the track 12.

Once the surface has been swiped by the squeegee 13, the invention 10 is removed and placed over a different planar surface having the squeegee 13 raised to the original position in order for the process to start over.

Figure 4:
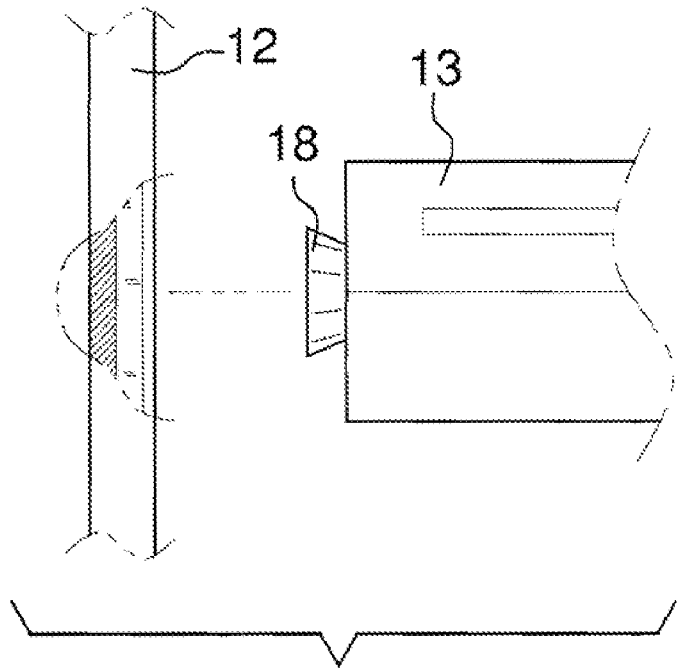
FIG. 4 illustrates a cut away of the track and an exploded view of the track and guide roller assembly.
Figure 5:
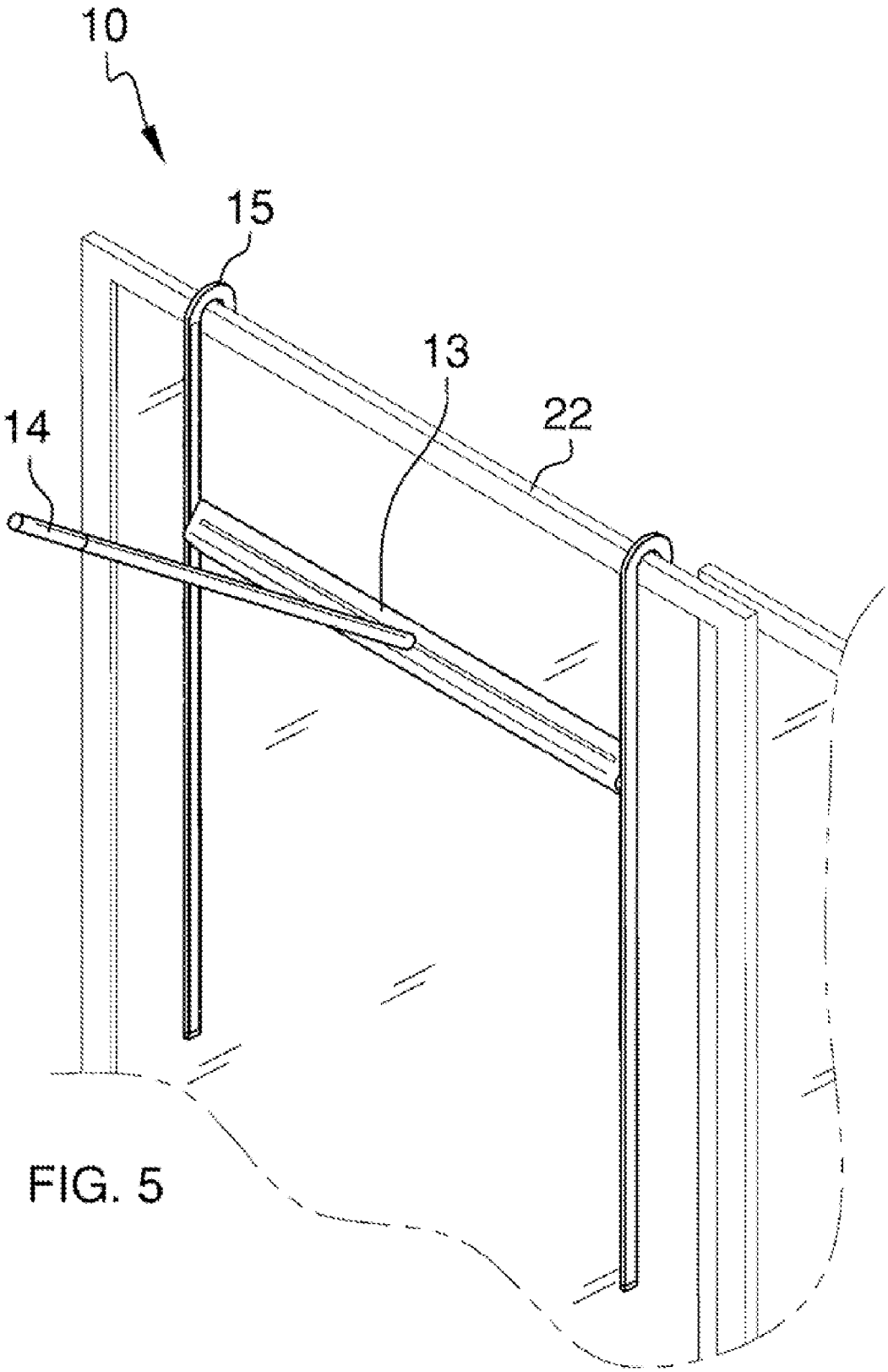
FIG. 5 illustrates an isometric view of the invention in use.

The squeegee 13 consists of a squeegee handle track 19 wherein the squeegee handle 14 mounts inside the squeegee 13, and a roller assembly 18 mounts on either outer side of the squeegee 13. FIG. 4 illustrates how one of the two roller assemblies 18 fit inside of the track 12. The squeegee includes a squeegee blade 20 mounted to the bottom of the squeegee 13.

It should be noted that the primary benefit of the invention 10 is to enable an end user with the ability to clean planar surfaces without having to bend over or kneel down. Furthermore, the incorporation of the tracks 12 and the squeegee handle 14 provides leverage to the end user over the planar surface to be cleaned, thereby requiring the end user to exert less strength over the squeegee.

Figure 6:
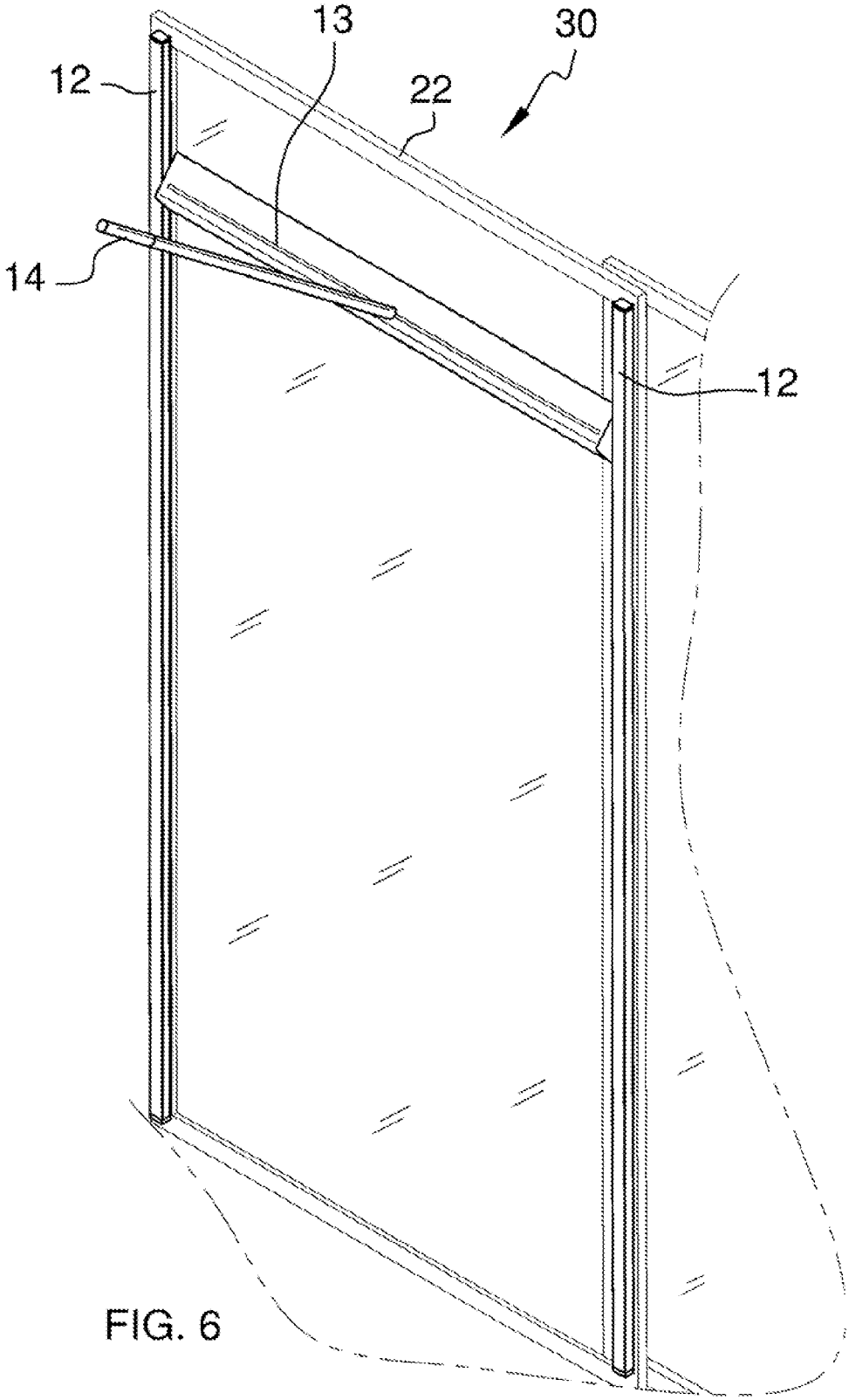
FIG. 6 illustrates an isometric view of an alternative embodiment having a track mounted on a shower door.

Referring to FIG. 6, an alternative embodiment 30 includes the same parts as the invention 10 described above, with the exception that the tracks 12 are mounted to the frame of the shower door 22. The alternative embodiment 30 operates in the same fashion as the above described invention 10.

Figure 7:
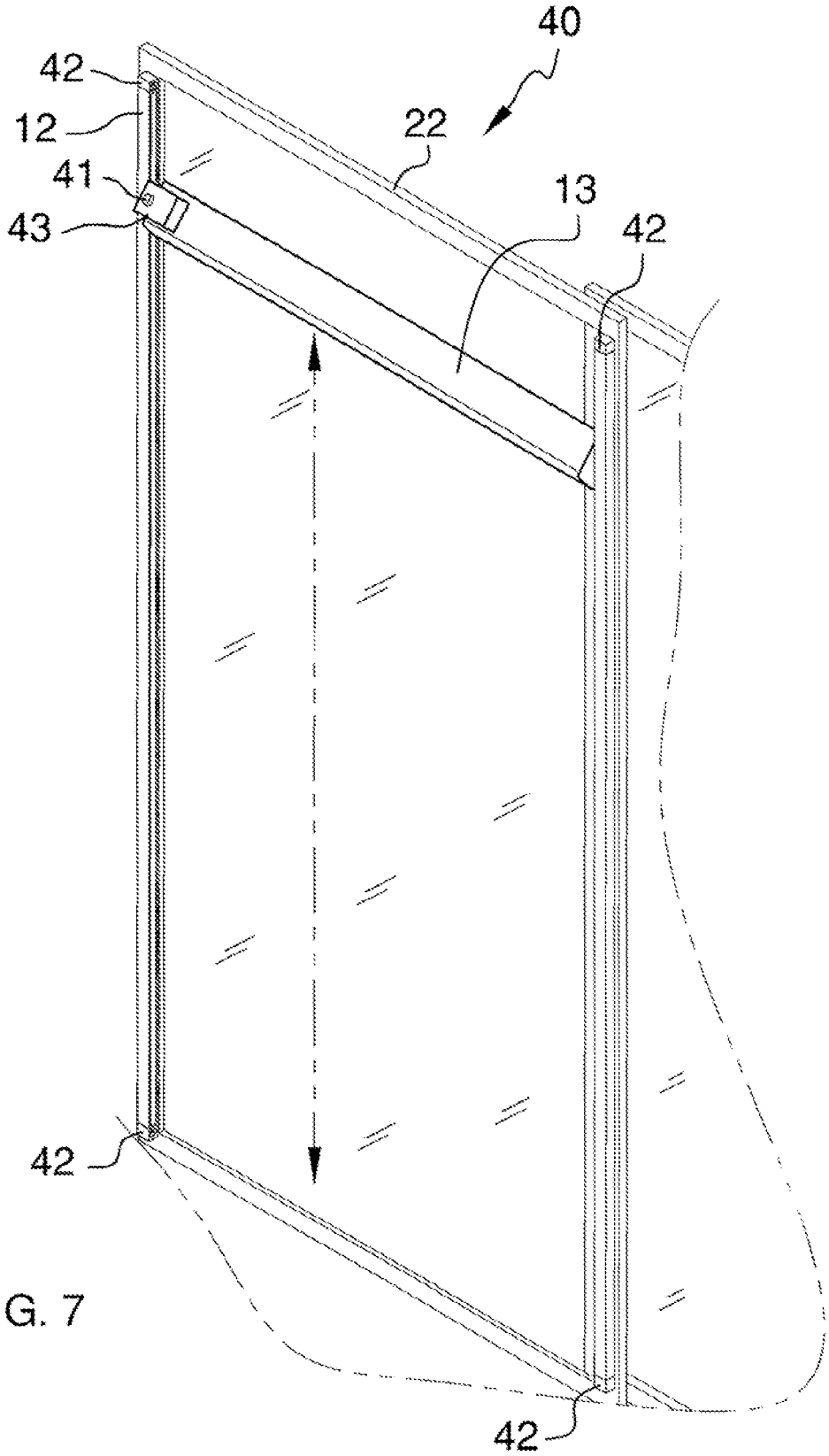
FIG. 7 illustrates an isometric view of a third embodiment having a motorized assembly that is track mounted on a shower door.

Referring to FIG. 7, a third embodiment 40 includes the same parts and configuration as the alternative embodiment 30 minus the use of the handle 14. Instead, the third embodiment 40 includes a power button 41, a pair of sensors 42, a housing 43, a battery (not shown), a motor (not shown), and a drive gear (not shown).

The third embodiment 40 has the tracks 12 mounted to the frame of the shower door 22. The third embodiment operates by depressing the power button 41, which in turn delivers electricity from the plurality of batteries (not shown) to the motor (not shown), which powers the drive gear (not shown). The drive gear (not shown) is in contact with the track 12, and can traverse the squeegee 13 up and down via the track 12.

The squeegee 13 will move down the track 12 until one of the sensors 42 comes into contact with the squeegee 13. Once one of the sensors 42 contact the squeegee 13, the motor reverses the direction of rotation, which in turn causes the drive gear to rotate backwards thereby causing the squeegee 13 to traverse back up the track 12. The squeegee 13 will traverse back up the track 12 until the squeegee 13 crosses the sensor 42 located at the top of the tracks 12 after which the squeegee 13 will cease moving.

The tracks 12, roller assembly 18, and handle 14 are made of a durable material comprising wood, metal, or plastic.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A track-mounted squeegee system comprising:

(a) a pair of tracks;

wherein the bottom of each track assembly has a rubber pad enclosing the track;

wherein the top of each track has a hook type apparatus which allows the system to hook over a top edge of a planar surface;

(b) a squeegee;

wherein the squeegee has a blade assembly consisting of a blade or a plurality of blades;

(c) a pair of roller assemblies;

wherein a roller assembly is permanently mounted to each end of the squeegee;

wherein each track is designed to accommodate the roller assembly and aid in moving the squeegee horizontally in an upward and downward motion along the track;

(d) a squeegee handle;

wherein the handle is mounted to a track located on the squeegee at a centered position along the longitudinal length of the squeegee; and wherein the handle allows the user the move the squeegee up and down the tract without having to bend-over or kneel down.

2. The track-mounted squeegee system of claim 1 wherein the rubber pads are made of a durable rubber.

3. The track-mounted squeegee system of claim 1 wherein the roller assemblies and the track are made of a material comprising metal or a durable plastic.

* * * * *